US009863074B2

(12) United States Patent
Nakajima

(10) Patent No.: US 9,863,074 B2
(45) Date of Patent: Jan. 9, 2018

(54) CORD GUIDE DEVICE AND SEWING MACHINE PROVIDED WITH SAME

(71) Applicant: JANOME SEWING MACHINE CO., LTD., Hachioji-shi, Tokyo (JP)

(72) Inventor: Makoto Nakajima, Hachioji (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 331 days.

(21) Appl. No.: 14/827,651

(22) Filed: Aug. 17, 2015

(65) Prior Publication Data

US 2016/0230323 A1 Aug. 11, 2016

(30) Foreign Application Priority Data

Feb. 10, 2015 (JP) ..... 2015-024394

(51) Int. Cl.
*D05C 7/08* (2006.01)
*D05B 29/10* (2006.01)

(52) U.S. Cl.
CPC ..... *D05C 7/08* (2013.01); *D05B 29/10* (2013.01); *D05D 2303/08* (2013.01)

(58) Field of Classification Search
CPC ..... D05B 29/08; D05B 29/10; D05B 35/06; D05C 7/08
USPC ..... 112/99, 100, 101, 104, 136, 139, 235, 112/236, 308, 309
See application file for complete search history.

(56) References Cited

U.S. PATENT DOCUMENTS 76,054 A * 3/1868 Contessa ..... D05B 29/06 112/139
128,825 A * 7/1872 Thomas ..... D05B 29/06 112/139
268,565 A * 12/1882 Sprague ..... D05B 29/06 112/139
1,182,279 A * 5/1916 Karle ..... D05B 29/06 112/139
1,593,288 A * 7/1926 Card, Jr. ..... D05B 27/24 112/139
2,095,080 A * 10/1937 Esteban ..... D05B 35/06 112/139
2,686,484 A * 8/1954 Cuthbertson ..... D05B 35/06 112/139
2,737,914 A * 3/1956 Hofgesang ..... D05B 35/06 112/139

(Continued)

FOREIGN PATENT DOCUMENTS

JP 2008-183287 A 8/2008

*Primary Examiner* — Danny Worrell
(74) *Attorney, Agent, or Firm* — Westerman, Hattori, Daniels & Adrian,

(57) ABSTRACT

A cord guide device that is attached to a guide attachment rod of a sewing machine body, the cord guide device including a disc-shaped cord guide in which a needle hole through which a sewing needle passes is provided in a center and in which a guide hole through which a piece of cord or the like passes is provided, the guide hole being positioned eccentrically with respect to the needle hole; a guide support board that supports an underside of the cord guide; a pressing holder that, by being connected to the guide support board, restricts an upper surface of the cord guide and holds the cord guide such that the cord guide is rotatable about the needle hole; and a rotation mechanism that rotates the cord guide according to a movement of a piece of cloth.

20 Claims, 10 Drawing Sheets

(56) References Cited

U.S. PATENT DOCUMENTS

| | | | | |
|---|---|---|---|---|
| 5,317,981 | A * | 6/1994 | Hashiride | D05B 29/02 112/102.5 |
| 6,748,889 | B2 * | 6/2004 | Martelli | D05B 29/08 112/235 |
| 7,080,605 | B1 * | 7/2006 | Anderson | D05B 27/12 112/318 |
| 7,134,399 | B1 * | 11/2006 | Gulsby | D05B 35/06 112/139 |
| 8,850,999 | B1 * | 10/2014 | Kalkbrenner | D05B 21/002 112/308 |
| 9,150,991 | B1 * | 10/2015 | Kalkbrenner | D05B 21/002 |
| 9,631,307 | B2 * | 4/2017 | Shomura | D05B 29/08 |

* cited by examiner

CORD GUIDE DEVICE AND SEWING MACHINE PROVIDED WITH SAME

BACKGROUND OF THE INVENTION

1. Field of the Invention

The present disclosure is related to a cord guide device that guides an embroidery material such as a piece of cord when carrying out embroidery sewing with a sewing machine, and, in particular, relates to a cord guide device that guides a piece of cord or the like to a sewing position so that the cord or the like does not deviate from a needle location point when sewing the cord or the like onto a piece of cloth and to a sewing machine provided with the cord guide device.

2. Description of the Related Art

In embroidery sewing, there is a method of sewing a piece of cord or the like that is a string-like embroidery material, such as a piece of cord or tape, onto a piece of cloth.

In order to sew a piece of cord or the like on a piece of cloth using a sewing machine by lock stitching that includes a needle thread and a bobbin thread, the cord or the like needs to be reliably guided to the needle location point and, accordingly, sewing machines provided with a cord guide device in order to reliably guide the cord or the like are widely known.

A guide device in an embroidery machine is hitherto known that includes a rotating body that is rotatably attached in a coaxial manner to a needle bar that vertically moves and to which a sewing needle is attached, a guide portion that is attached to the rotating body and that guides a piece of cord or the like to the needle location point, and a guide driving device that rotates the rotating body. The guide device controls the rotation of the rotating body through computer control on the basis of embroidery data so as to change a direction of the guide portion so that the cord or the like is appropriately guided in accordance with the sewing direction (see Japanese Unexamined Patent Application Publication No. 2008-183287, for example).

SUMMARY OF THE INVENTION

However, a guide mechanism 40 of the embroidery machine described in Japanese Unexamined Patent Application Publication No. 2008-183287 described above is a bulky and complicated device including a hollow shaft member 41 that is slidably and rotatably provided on an outer periphery of a vertically moving cloth presser 15, a heavy bobbin 60 that is attached to the hollow shaft member 41, and a guide driving device 65 that rotates the hollow shaft member 41. The guide mechanism 40 also needs a controller that controls the rotation of the guide mechanism 40 on the basis of embroidery data; accordingly, the sewing machine is disadvantageously complicated and costly.

Particularly, in sewing a cord or the like with a household sewing machine that is not a special purpose embroidery machine, a more simple cord guide device that is easier to mount and dismount is in need, and in some cases, the cord or the like is required to be sewed by manually moving the piece of cloth without using the automatic embroidery device using embroidery data.

The present disclosure aims to overcome the above disadvantages and an object thereof is to provide a cord guide device that is capable of guiding the cord or the like to the sewing position without the cord or the like deviating from the needle location point by just moving the cloth onto which the cord or the like is sewed and that has a simple structure that facilitates mounting and dismounting thereof, and to provide a sewing machine provided with the cord guide device.

In order to overcome the above disadvantages, a cord guide device of the present disclosure is a cord guide device that is attached to a guide attachment rod of a sewing machine body, the cord guide device including a disc-shaped cord guide in which a needle hole through which a sewing needle passes is provided in a center and in which a guide hole through which a piece of cord passes is provided, the guide hole being positioned eccentrically with respect to the needle hole; a guide support board that supports an underside of the cord guide; a pressing holder that, by being connected to the guide support board, restricts an upper surface of the cord guide and holds the cord guide such that the cord guide is rotatable about the needle hole; and a rotation mechanism that rotates the cord guide according to a movement of a cloth.

As a specific exemplary embodiment of the cord guide device, a configuration may be adopted in which the rotation mechanism includes a guide arm that extends from the underside of the cord guide, a rotating shaft that is attached to a lower end portion of the guide arm, and a rotating body that is attached to the rotating shaft serving as an axis of symmetry, the rotating body being in contact with the cloth, and in which the rotating shaft is disposed in a direction orthogonal to a line connecting a center of the guide hole and a center of the needle hole, the rotating shaft being attached to the guide arm at a position that is on an opposite side of the guide hole with respect to the needle hole and that is eccentric by a predetermined distance from the needle hole. Furthermore, a configuration in which the rotating body is a cylindrical roller may be employed and a configuration in which the cord guide includes an operation reception portion that includes an insertion hole that extends in a radial direction and an operation lever that is capable of being fitted into the operation reception portion may be employed.

As another exemplary embodiment of the cord guide device, the rotation mechanism may employ a configuration in which the rotation mechanism includes an angle sensor that detects a direction in which the cloth has moved with respect to a reference axis direction in plan view, and a drive mechanism that rotates the cord guide so that the guide hole is positioned, with respect to the needle hole, in a direction opposite to the direction detected by the angle sensor in which the cloth has moved, the rotation mechanism may employ a configuration in which the angle sensor includes a ball that comes into contact with the cloth and that freely rotates with frictional force with the cloth, two rollers that rotate by being in contact with the ball, axes of the two rollers being orthogonal with respect to each other in plan view, encoders that each detect an amount of rotation of the corresponding one of the rollers, and an angle calculation unit that calculates, on a basis of detection data of the encoders, the direction in which the cloth has moved, and, furthermore, the rotation mechanism may employ a configuration in which the drive mechanism includes a drive motor, a drive gear that is attached to a rotating shaft of the drive motor, and a transmission gear that meshes with the drive gear and that transmits a rotation to the cord guide.

Furthermore, a sewing machine of the present disclosure employs a configuration provided with either one of the cord guide devices described above in order to overcome the above disadvantages.

In the cord guide device of the present disclosure, since the disc-shaped cord guide that is provided with a guide hole that is positioned eccentrically with respect to the needle hole at the center is held in a rotatable manner about the needle hole with the guide support board and the pressing holder and is rotated in accordance with the movement of the cloth by the rotation mechanism, when sewing the cord or the like onto the cloth, the cord guide can be rotated in accordance with the movement of the cloth and the guide hole can always be positioned in the sewing direction (a direction opposite to the moving direction of the cloth) such that the cord or the like can be guided to the sewing position without the cord or the like being deviated from the needle location point.

Furthermore, since the cord guide and the guide support board have disc shapes with the needle hole at the center, the cord guide and the guide support board functions as a cloth presser that suppresses the cloth from rising caused by rising of the sewing needle; accordingly, a complicated cloth presser mechanism is not separately required.

While the cord guide device of the present disclosure has a simple and compact structure as described above, the cord guide device is capable of reliably guiding the cord or the like to the sewing position, is a device that facilitates mounting and dismounting thereof, and is a device that can be easily used.

Furthermore, in the exemplary embodiment in which the rotation mechanism includes the rotating body that comes into contact with the cloth and that is attached to the rotating shaft, which is attached to the guide arm extending from the underside of the cord guide and which serves as an axis of symmetry, and in which the rotating shaft is disposed orthogonally to the line connecting the center of the guide hole and the center of the needle hole and is attached to the guide arm at a position that is on the opposite side of the guide hole with respect to the needle hole and that is eccentric by a predetermined distance from the needle hole, the cord guide can be rotated by manually moving the cloth; accordingly, embroidery sewing using the cord or the like can be performed without using a controller and a rotation device that are complicated and costly.

Furthermore, in the exemplary embodiment including the drive mechanism that rotates the cord guide so that the guide hole is, with respect to the needle hole, positioned in the direction opposite to the direction, detected by the angle sensor, in which the cloth has moved, since the force to rotate the cord guide is exerted by the drive mechanism, the movement of the cloth can be performed in a further swift manner.

BRIEF DESCRIPTION OF THE DRAWINGS

FIGS. 3A and 3B are diagrams illustrating the cord guide device of the first exemplary embodiment, in which FIG. 3A is a side view and FIG. 3B is a bottom view.

FIG. 4A is a front view, FIG. 4B is a side view, and FIG. 4C is a bottom view.

FIG. 5A is a front view, FIG. 5B is a side view, and FIG. 5C is a bottom view.

FIG. 6A is a front view, FIG. 6B is a side view, and FIG. 6C is a bottom view.

FIGS. 7A and 7B are diagrams illustrating a second exemplary embodiment of the cord guide device of the present disclosure, in which FIG. 7A is an exploded perspective view and FIG. 7B is a perspective view illustrating a state in which the cord guide device has been assembled and an operation lever is inserted in the cord guide device.

FIGS. 8A to 8C are diagrams illustrating the cord guide device of the second exemplary embodiment, in which FIG. 8A is a front view, FIG. 8B is a side view, and FIG. 8C is a bottom view.

FIGS. 9A and 9B are diagrams illustrating a third exemplary embodiment of the cord guide device of the present disclosure, in which FIG. 9A is an exploded perspective view and FIG. 9B is a perspective view illustrating a cord guide device that has been assembled.

FIGS. 10A and 10B are diagrams for describing an angle sensor of the cord guide device of the third exemplary embodiment, in which FIG. 10A is a schematic diagram of the angle sensor and FIG. 10B is a diagram for describing a method of detecting a direction in which the cloth has moved.

DESCRIPTION OF THE PREFERRED EMBODIMENTS

A cord guide device of the present disclosure will be described next with reference to the drawings illustrating the exemplary embodiments.

First Exemplary Embodiment

Figure 1:
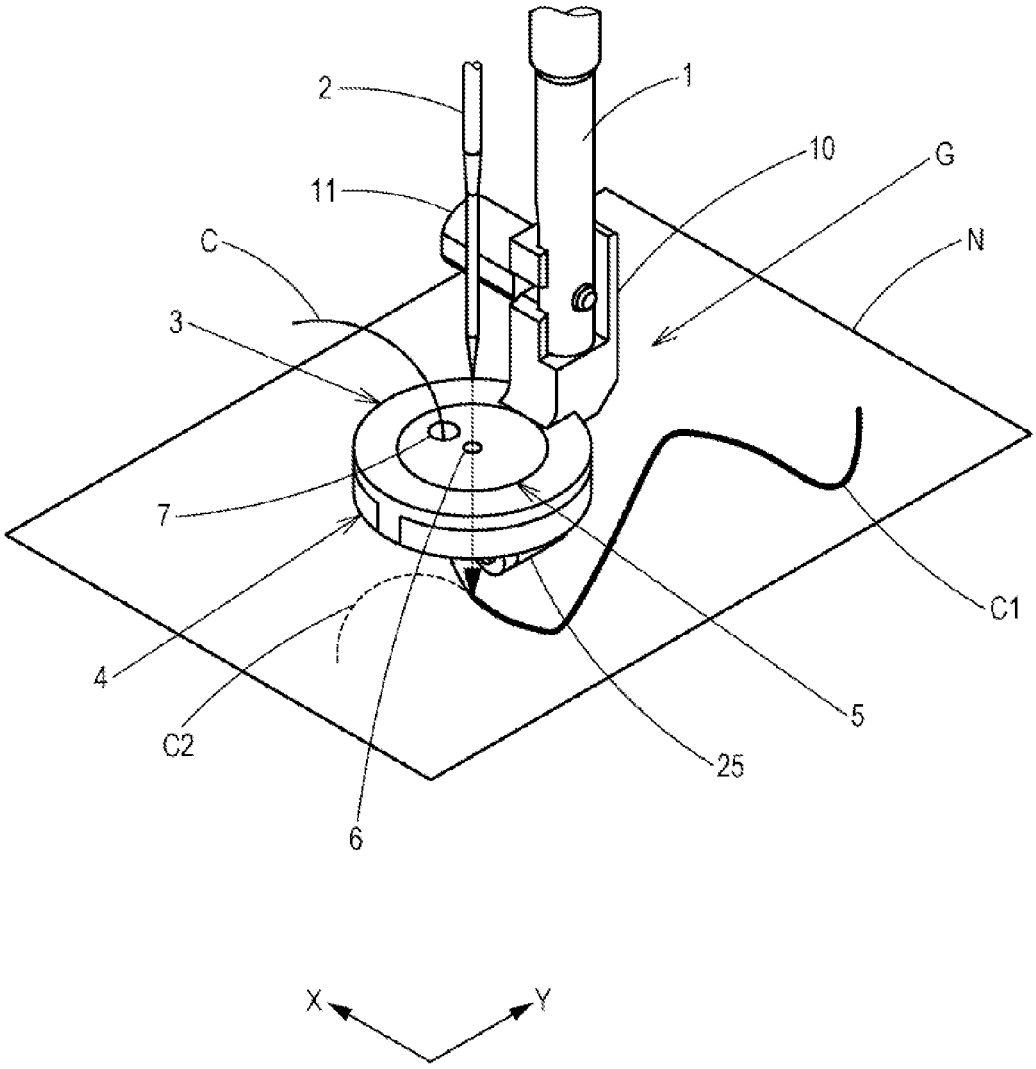
FIG. 1 is a perspective view illustrating a state in which a piece of cord is sewed onto a piece of cloth using a cord guide device of a first exemplary embodiment of the present disclosure.

A guide attachment rod 1 illustrated in FIG. 1 is fixed to a sewing machine body (not shown) and is provided immediately behind a sewing needle 2 so as to hang therefrom when viewed from a sewer positioned on a front side of the sewing machine.

A cord guide device G is attached to a lower end of the guide attachment rod 1 through a holder arm 10 with a bolt 11.

The cord guide device G includes a disc-shaped cord guide 5 that includes a needle hole 6 through which the sewing needle 2 is passed and a guide hole 7 through which a piece of cord C is passed, a guide support board 4 that supports an underside of the cord guide 5, and a pressing holder 3 that restricts an upper surface of the cord guide 5 and that is mounted on the guide attachment rod 1 with the holder arm 10.

A roller 25 described later is attached to a lower portion of the cord guide 5 so as to be in contact with a piece of cloth N.

Reference numeral N in FIG. 1 is a piece of cloth onto which a piece of cord or the like is sewed and is capable of being moved on a bed (not shown) of the sewing machine in the XY direction by being held by an embroidery frame and the like. Reference numeral C1 is a piece of cord that has been sewed onto the cloth N and reference numeral C2 illustrated by a broken line illustrates a track onto which the cord C is planned to be sewed.

Figure 2:
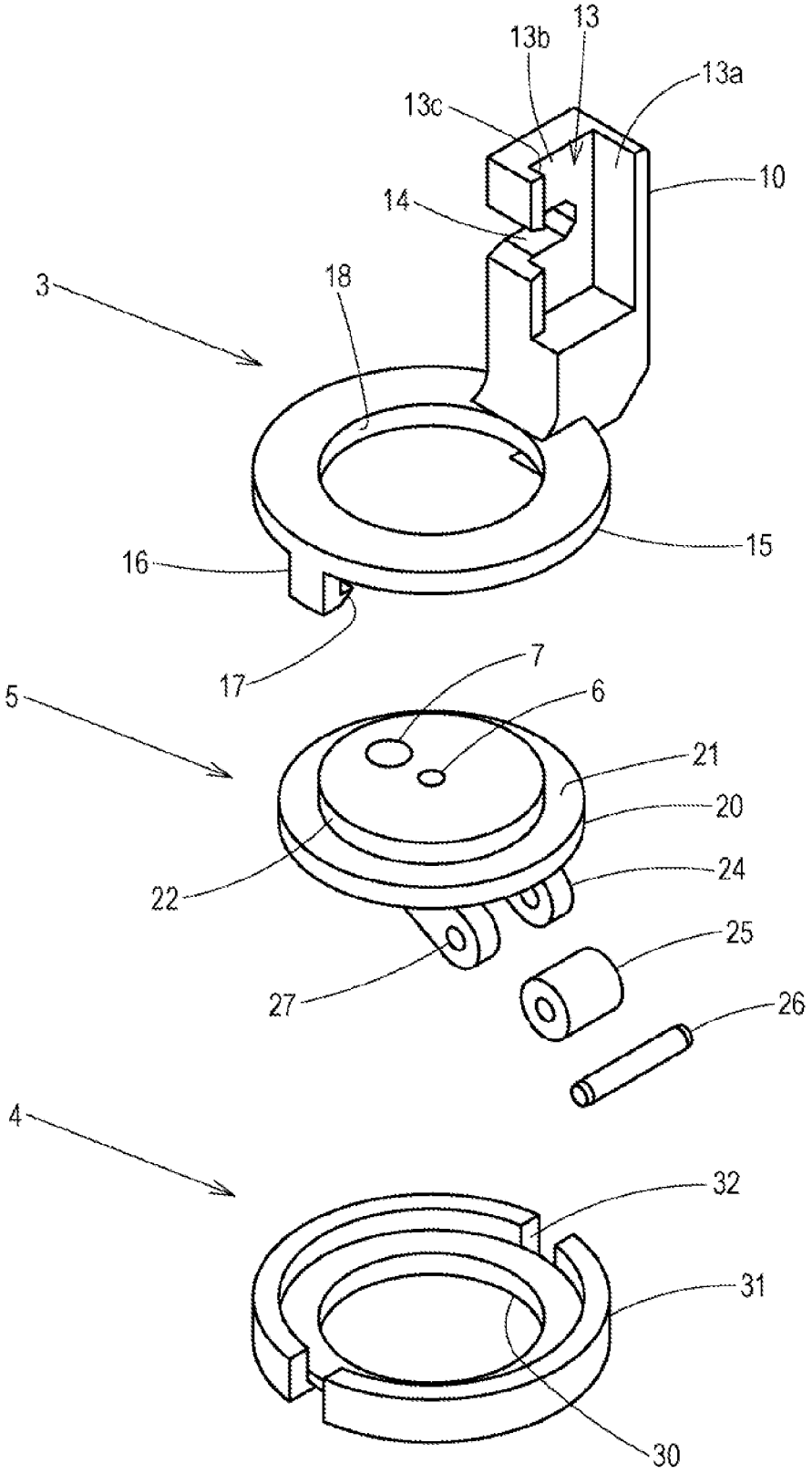
FIG. 2 is an exploded perspective view of the cord guide device of the first exemplary embodiment.

As illustrated in FIG. 2, the pressing holder 3 includes the holder arm 10 and a ring-shaped pressing upper plate 15 that is integrally formed with the holder arm 10 or that is integrally fixed to the holder arm 10.

In the holder arm 10, a recess 13 into which the guide attachment rod 1 is fitted forms three surfaces 13*a*, 13*b*, and 13*c* that extend in an axis direction from an upper portion of the holder arm 10 and that are orthogonal to each other. The two surfaces 13*a* and 13*b* and the two surfaces 13*b* and 13*c* that are orthogonal to each other determine the position of the pressing holder 3 with respect to the guide attachment rod 1 in plan view.

Furthermore, a horizontal bolt hole 14 that extend perpendicularly with respect to the axis direction and into which the bolt 11 is fitted is provided in the lateral surface of the holder arm 10 so as to cut away the recess 13.

Each of the surfaces of the recess 13 and the horizontal bolt hole 14 configures a positioning mechanism that positions the cord guide device G with respect to the sewing machine through the pressing holder 3.

Connection portions 16 are provided so as to hang from two opposing portions in the outer peripheral edge of the pressing upper plate 15, and hook portions 17 that protrude towards the inner side are provided on the lower ends of the connection portions 16.

A projection 22 that concentrically protrudes on an upper surface 21 of a disc-shaped base 20 and that slidably fits into a centering hole 18 that forms an inner peripheral edge of the pressing upper plate 15 is provided in the cord guide 5.

Figure 3A:
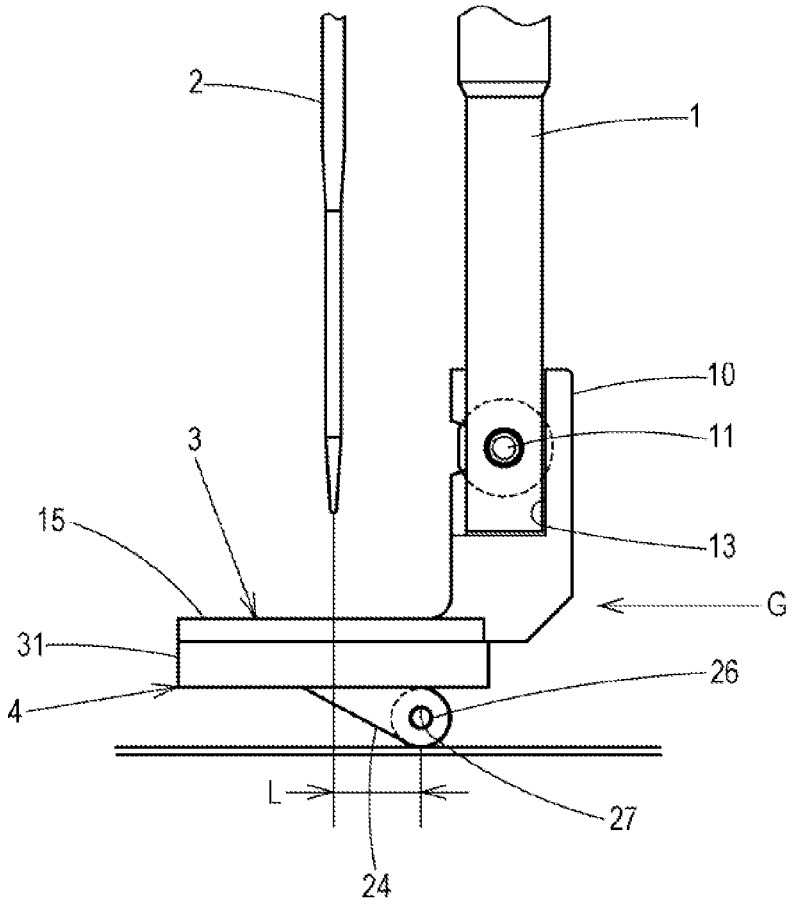
Figure 3B:
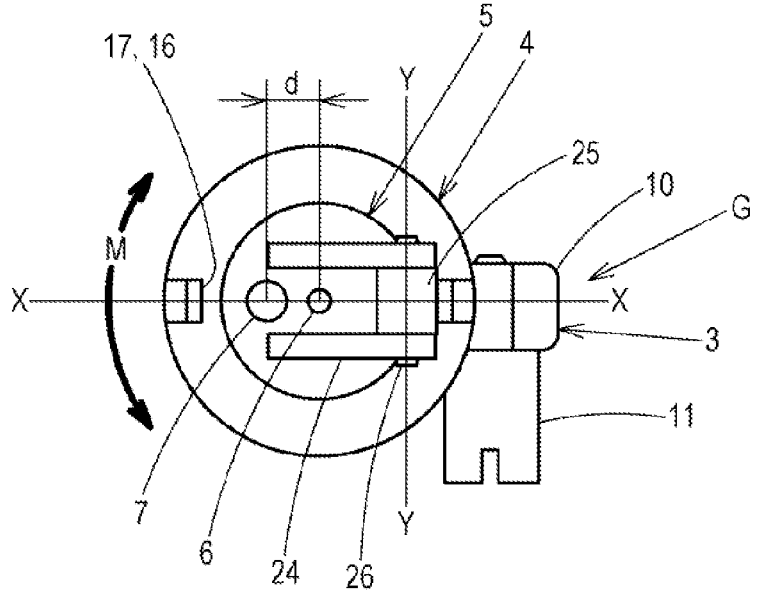

As illustrated in FIG. 3B the guide hole 7 is drilled eccentrically and apart at a predetermined distance d with respect to a center of the needle hole 6 that is drilled at the center of the cord guide 5. The guide hole 7 functions so as to pass the cord C therethrough from above and to guide the cord C to a needle location point therebelow.

Furthermore, guide arms 24 having the needle hole 6 therebetween extend obliquely downwards from an underside of a base 20 of the cord guide 5, and shaft holes 27 are provided so as to be set apart at a predetermined distance L from the center of the needle hole 6 and in a direction orthogonal to an X-X line connecting the centers of the needle hole 6 and the guide hole 7 in plan view.

A rotating shaft 26 to which the roller 25 is attached is disposed in a Y-Y line direction that is orthogonal to the X-X line and is rotatably fitted to the shaft holes 27. The roller 25 comes into contact with the cloth N on the Y-Y line that coincides with the rotating shaft 26 in plan view and that is set apart at the predetermined distance L from the center of the needle hole 6.

Note that it is only required that the roller 25 that fits onto the rotating shaft 26 has a shape of a rotating body that has the rotating shaft 26 at the axis of symmetry, and the roller 25 is not limited to the cylindrical roller and maybe a roller having a spherical shape or a roller with an elliptic cross section.

The guide support board 4 includes a ring-shaped bottom plate 30 and a peripheral wall 31 that stands from a periphery of the bottom plate 30 so as to have a predetermined height. Cutaways 32 into which the connection portions 16 fit are provided in two portions of the peripheral wall 31 at symmetrical positions that oppose each other with respect to an axial center of the peripheral wall 31.

An upper surface of the bottom plate 30 supports the underside of the base 20 of the cord guide 5, and the guide arms 24 protrude from the underside of the base 20 inside an inner periphery of the bottom plate 30 such that free rotation of the cord guide 5 is assured.

A height of the peripheral wall 31 is configured so as to be slightly higher than a height of the upper surface 21 of the base 20 such that when an underside of the bottom plate 30 is engaged with the hook portions 17 of the connection portions 16, an upper end of the peripheral wall 31 abuts against the pressing upper plate 15; accordingly, the upper surface 21 and an underside of the pressing upper plate 15 do not frictionally slide with respect each other and the cord guide 5 rotates smoothly.

Use modes and effects of the present exemplary embodiment will be described next with reference to the drawings.

In order to assemble the cord guide device G from a state in FIG. 2, first, the roller 25 is attached to the lower portion of the cord guide 5 through the guide arms 24 with the rotating shaft 26.

While inserting the roller 25 on an inner peripheral side of the bottom plate 30, the base 20 of the cord guide 5 is fitted inside the peripheral wall 31 of the guide support board 4 such that the upper surface of the bottom plate 30 supports a peripheral edge portion of the underside of the base 20.

While supporting the cord guide 5, when the connection portions 16 are placed on the cutaway 32 of the guide support board 4 and the pressing holder 3 is pressed from above, the hook portions 17 are moved over an outer peripheral edge of the bottom plate 30 and are engaged with the underside of the bottom plate 30 such that the pressing holder 3 and the guide support board 4 are connected to each other.

At this moment, the centering hole 18 of the pressing upper plate 15 is slidably fitted onto the projection 22 of the cord guide 5 and the underside of the pressing upper plate 15 abuts against the upper end of the peripheral wall 31 such that the cord guide 5 is centered by the centering hole 18 of the pressing upper plate 15 and, as illustrated in FIG. 3B, the cord guide 5 is made capable of rotating smoothly about the needle hole 6 in an M-direction.

While fitting the bolt 11 into the horizontal bolt hole 14 of the holder arm 10, the assembled cord guide device G is moved horizontally until the guide attachment rod 1 abuts against the surface 13*a* of the recess 13 or until the bolt 11 abuts against an end portion of the horizontal bolt hole 14.

Then, after fastening the bolt 11 so that the guide attachment rod 1 is fitted between the surface 13*a* and the surface 13*c*, the bolt 11 is fastened furthermore while the holder arm 10 is positioned so that the guide attachment rod 1 abuts against the surface 13*c* such that the cord guide device G is positioned and fixed to the sewing machine body with the surfaces 13*b* and 13*c* that abut against the guide attachment rod 1 and with the bolt 11 and the horizontal bolt hole 14 (see FIG. 3A).

Note that in the present exemplary embodiment, the holder arm 10 and the centering hole 18 are provided in the pressing holder 3 so as to position the cord guide 5 with respect to the sewing machine body; however, the cord guide device G of the present disclosure is not necessarily limited to the above positioning and fixing mechanism and the mechanism for positioning and fixing the cord guide 5 to the guide attachment rod 1 and a mechanism for centering the cord guide 5 may be provided on the guide support board 4 side. In such a case, an inner peripheral surface of the peripheral wall 31 may be configured to be in contact with an outer peripheral surface of the base 20 in a slidable manner so as to be used as a centering mechanism.

Effects of the cord guide device G when sewing the cord C by moving the cloth N will be described with reference to FIGS. 4A to 6C.

Figure 4A:
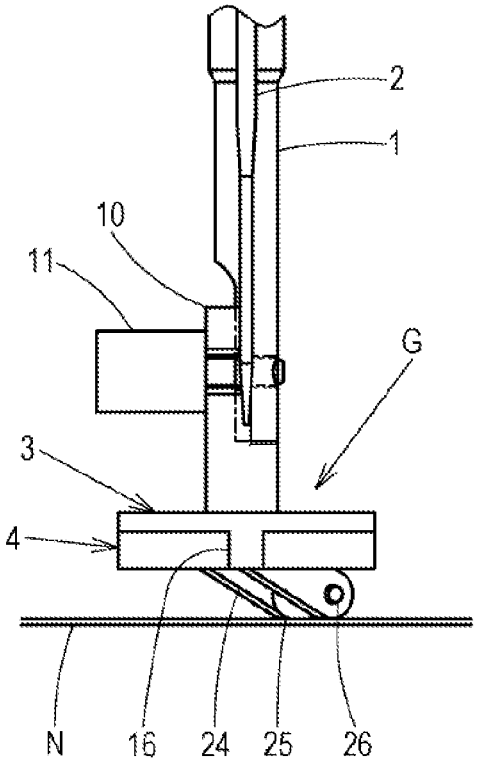
FIGS. 4A to 4C are diagrams illustrating the cord guide device of the first exemplary embodiment in a case in which the cloth is moved.
Figure 4B:
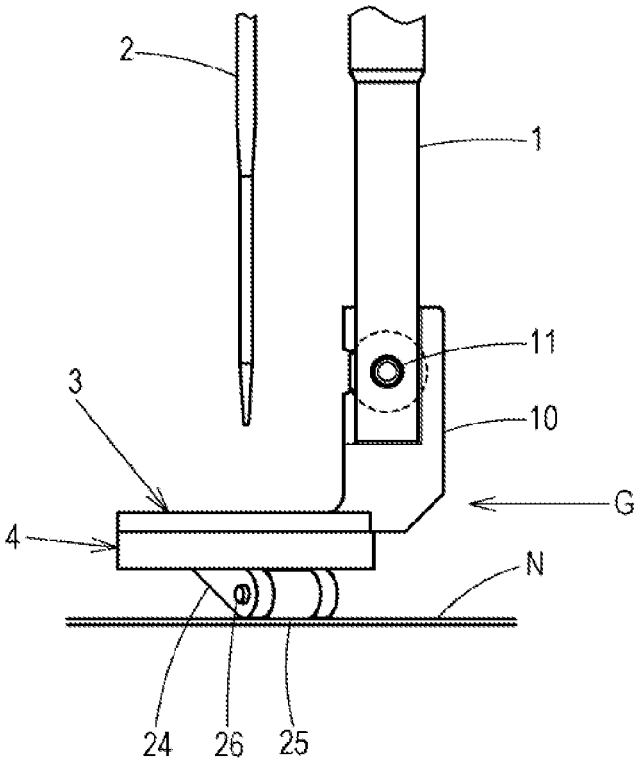
Figure 4C:
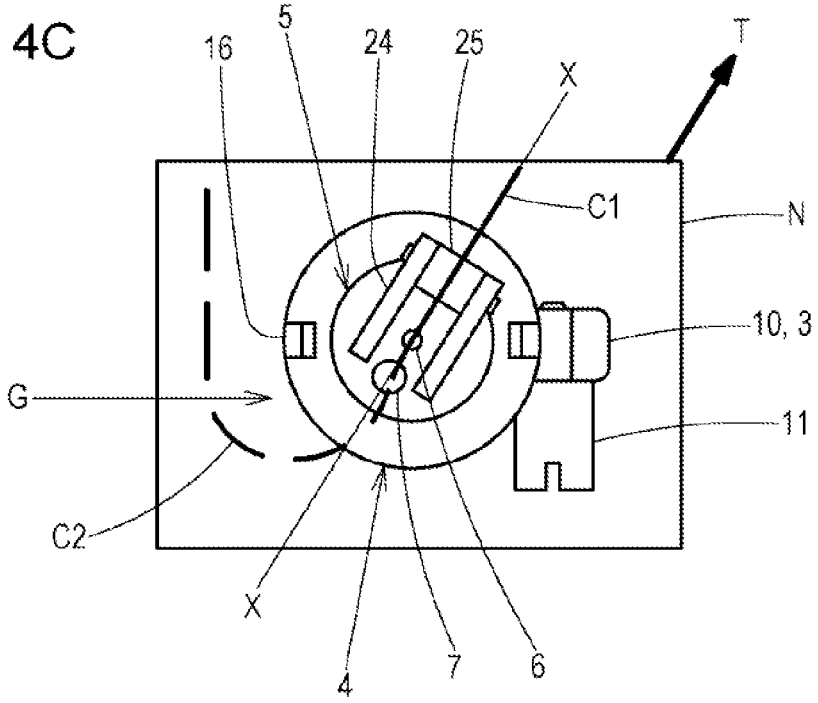
Figure 5A:
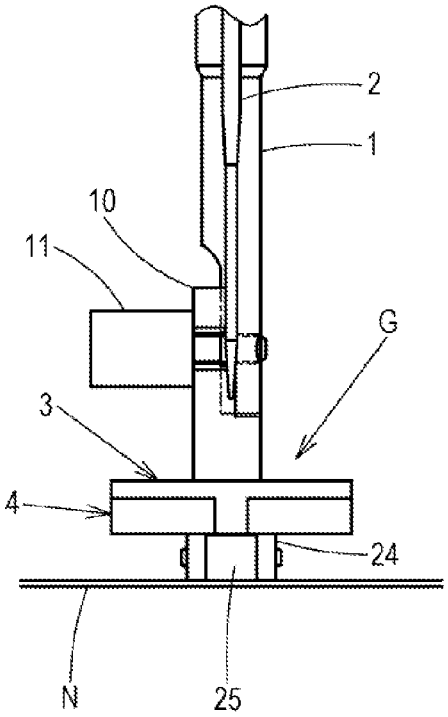
FIGS. 5A to 5C are diagrams illustrating the cord guide device of the first exemplary embodiment in a case in which the direction in which the cloth is moved is changed from the state illustrated in FIGS. 4A to 4C.
Figure 5B:
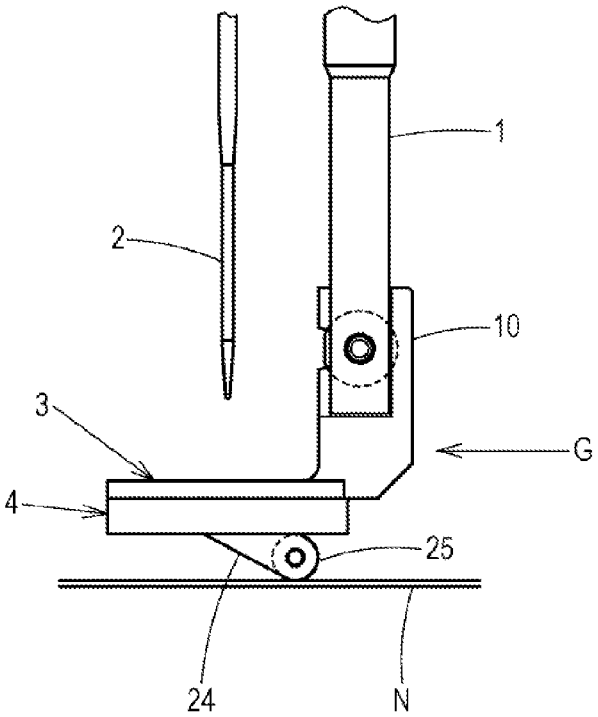
Figure 5C:
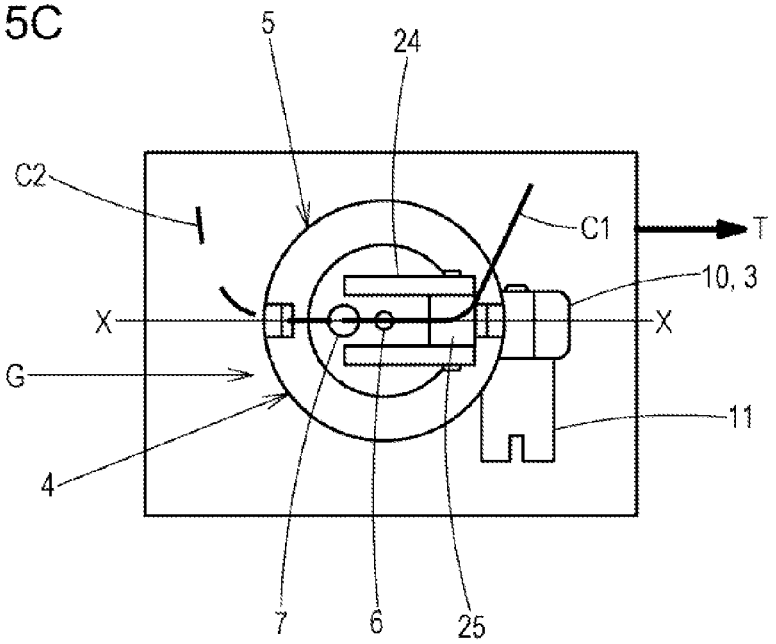
Figure 6A:
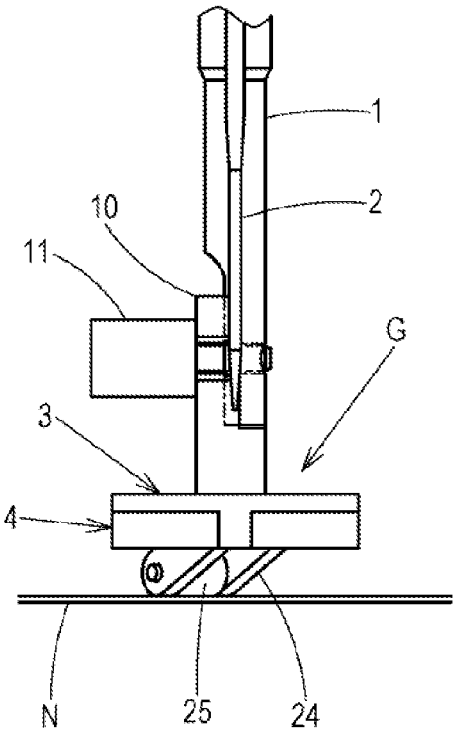
FIGS. 6A to 6C are diagrams illustrating the cord guide device of the first exemplary embodiment in a case in which the direction in which the cloth is moved is further changed from the state illustrated in FIGS. 5A to 5C.
Figure 6B:
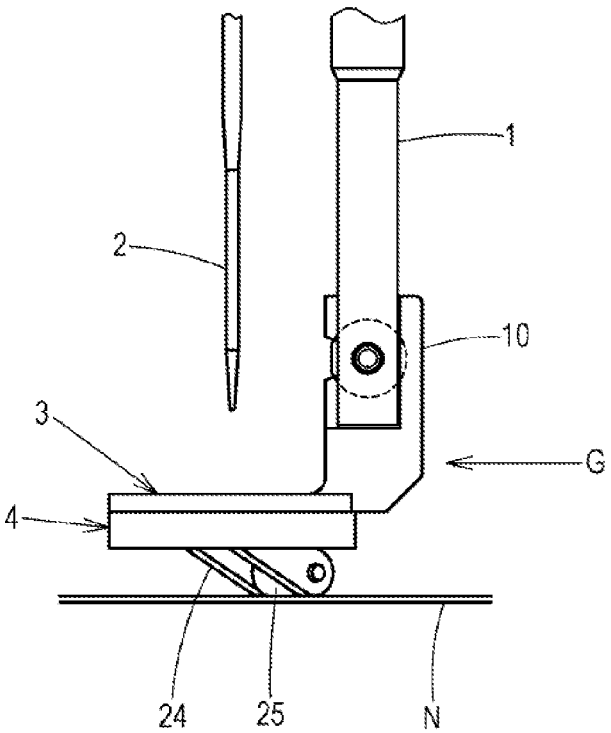
Figure 6C:
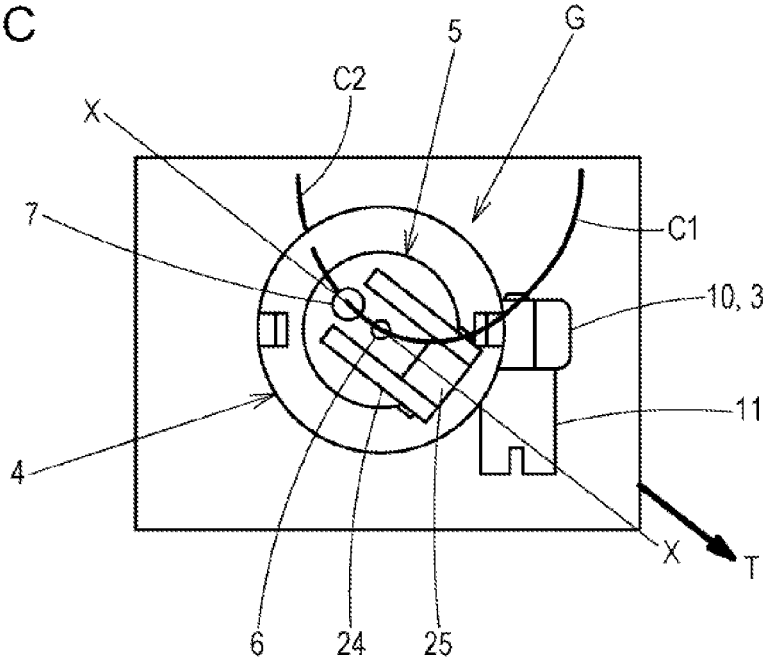

As illustrated in FIG. 4C, when the cloth N is moved in a T-direction, since the roller 25 is in contact with the cloth N at a position set apart by the distance L from the center of the needle hole 6, in other words, the center of the cord guide 5, the cord guide 5 rotates so that the guide arms 24 is oriented in the T-direction such that the X-X line that connects the guide hole 7 and the needle hole 6 coincides with the T-direction and such that the guide hole 7 is positioned on the line extending in a direction opposite to the T-direction with respect to the needle location point (the center of the needle hole).

As described above, in the present exemplary embodiment, a property of the roller trying to forward roll in the direction of movement (the so-called "caster effect" in which the arm of the roller moves so that the roller rotates to meet the direction of movement) is used. By moving the cloth N in the T-direction, the guide hole 7 can be positioned so as to always be oriented in the direction opposite to the T-direction with respect to the needle hole 6, in other words, in the sewing direction, and can be disposed on the planned track C2; accordingly, the sewing needle 2 can reliably catch the cord C and sew the cord C on the cloth N such that a track, that is, cord C1, is formed.

As the moving direction T of the cloth N is changed, as illustrated in FIGS. 5A to 6C, the cord guide 5 following the movement of the cloth N rotates so that the X-X line that connects the guide hole 7 and the needle hole 6 coincides with the T-direction.

With the above, the guide hole 7 is always positioned on the planned track C2 and in a direction opposite to the T-direction and, accordingly, the sewing needle 2 can keep on sewing while catching the cord C.

Note that in order for the cord C that has passed through the guide hole 7 to not deviate from the needle location point, a gap between the underside of the cord guide 5 and the cloth N is, desirably, small to the extent possible.

In the present exemplary embodiment, the cord guide 5 can be rotated and the cord C can be guided to the needle location point without using a particular driving unit or a controller by just moving the cloth N in the T-direction that is a direction opposite to the sewing direction.

Furthermore, since the cord guide 5 and the guide support board 4 have disc shapes with the needle hole 6 at the center and the gap between the underside and the cloth N is small, and since the roller 25 is in contact with the cloth N, the roller 25, the cord guide 5, and the underside of the guide support board 4 serve as a cloth presser that restrict the cloth N from rising; accordingly, a separate cloth presser mechanism is not required.

Furthermore, since the cord guide device G can be fixed to the sewing machine body by just attaching the holder arm 10 of the pressing holder 3 to the guide attachment rod 1, the present exemplary embodiment can be easily used in a household sewing machine that is not a special purpose embroidery machine.

Second Exemplary Embodiment

A second exemplary embodiment in which the cord guide is made rotatable by an operation lever and in which the connection mechanism of the pressing holder and the guide support board is changed will be described next.

Hereinafter, components that are the same as the first exemplary embodiment will be designated with the same reference numerals and points that are different will be described mainly.

As illustrated in FIGS. 7A to 8C, the cord guide 5 is equipped with an operation reception portion 43 that includes an insertion hole 44 into which an insertion piece 41 of an operation lever 40 can be fitted.

The operation reception portion 43 is provided on the underside of the base 20 so as to protrude therefrom and is provided on the outside of the guide arms 24 and inside an inner peripheral edge of the bottom plate 30 of the guide support board 4.

In the present exemplary embodiment, the insertion piece 41 is a flat tabular member and the insertion hole 44 has a rectangular-shaped mouth corresponding to the insertion piece 41; however, as long as the insertion piece 41 and the insertion hole 44 can be provided in a small gap between the underside of the guide support board 4 and the cloth N, the shapes of the insertion piece 41 and the insertion hole 44 are not limited to the above shapes.

The pressing holder 3 includes the holder arm 10 and a frame body 45 that is integrally provided with the holder arm 10.

The frame body 45 includes a ring-shaped upper plate 46 in which the centering hole 18 is provided and an outer peripheral wall 47 that is provided so as to hang from an outer peripheral edge of the upper plate 46. The outer peripheral wall 47 includes a hook-shaped hole 48 that includes an opening in a lower end thereof and that is bent in a crank-shape so as to extend in a circumferential direction, and a connection recess 49 that has cut away a predetermined circumferential region of the lower end of the outer peripheral wall 47 on the opposite side of the hook-shaped hole 48 in the circumferential direction.

A fitting projection 50 that is capable of being fitted into the hook-shaped hole 48 is provided in an upper portion of the outer periphery of the peripheral wall 31 of the guide support board 4 and a connection protrusion 51 is provided on a lower portion of the outer periphery on the opposite side of the fitting projection 50 in the circumferential direction.

A retaining hole 52 through which a retaining screw 53 penetrates is provided in the connection protrusion 51.

The connection protrusion 51 has a shape that is capable of being slid in the connection recess 49 in the circumferential direction within the range allowing the fitting projection 50 to be rotated until the fitting projection 50 fits into the portion of the hook-shaped hole 48 that is bent and that extends in the circumferential direction when the fitting projection 50 is fitted into the hook-shaped hole 48 through the lower end opening of the hook-shaped hole 48 and when the guide support board 4 is rotated.

In the present exemplary embodiment, the fitting projection 50 is a tabular member that has a width that is about half of the width of the hook-shaped hole 48 in the circumferential direction, and the connection protrusion 51 is a member that has a width that is about half of the width of the connection recess 49 in the circumferential direction.

Use modes and effects of the present exemplary embodiment will be described next with reference to the drawings.

Figure 7A:
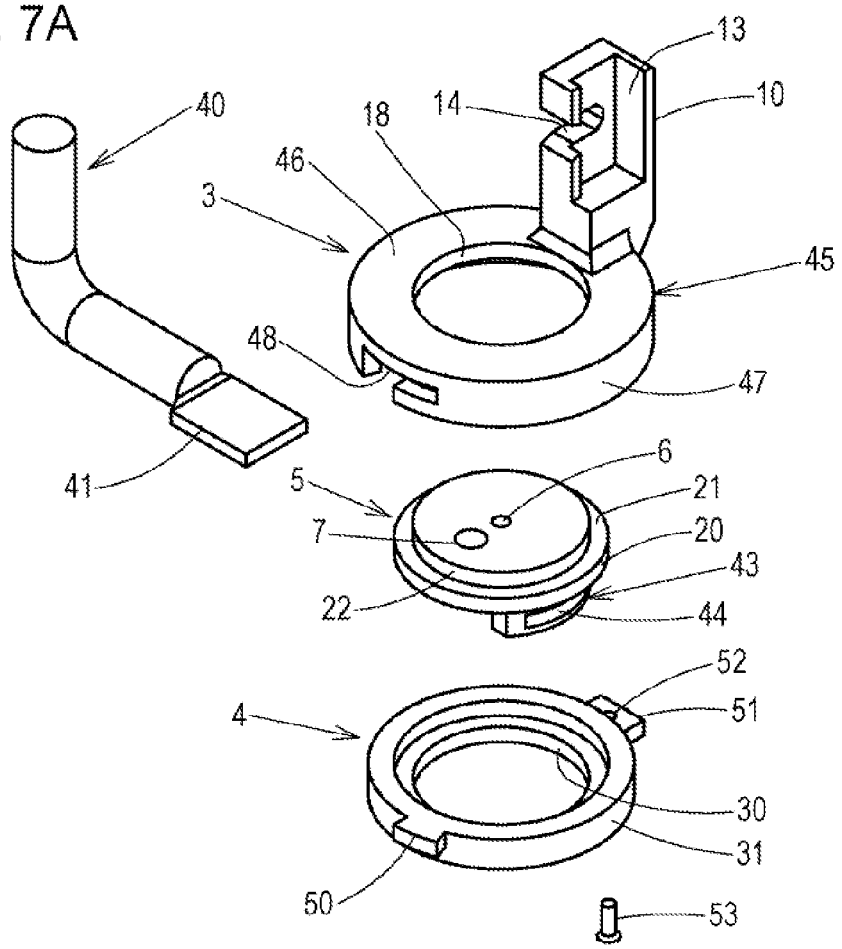

In order to assemble the cord guide device G from a state in FIG. 7A, first, while the roller 25 and the operation reception portion 43 are inserted into the inner peripheral side of the bottom plate 30, the base 20 of the cord guide 5 is fitted inside the peripheral wall 31 of the guide support board 4 such that the upper surface of the bottom plate 30 supports the underside of the peripheral edge portion of the base 20.

In a state in which the cord guide 5 is supported, while the fitting projection 50 of the guide support board 4 is fitted through the lower end opening of the hook-shaped hole 48, the peripheral wall 31 is fitted inside the frame body 45.

When the fitting projection 50 abuts against an upper end of the hook-shaped hole 48 and when the connection protrusion 51 abuts against the connection recess 49, the guide support board 4 is rotated and the fitting projection 50 is fitted into the portion of the hook-shaped hole 48 that is bent and that extends in the circumferential direction.

At this moment, the centering hole 18 of the upper plate 46 is slidably fitted onto the projection 22 of the cord guide 5 and the cord guide 5 is centered by the centering hole 18 such that the cord guide 5 rotates smoothly about the needle hole 6.

Figure 7B:
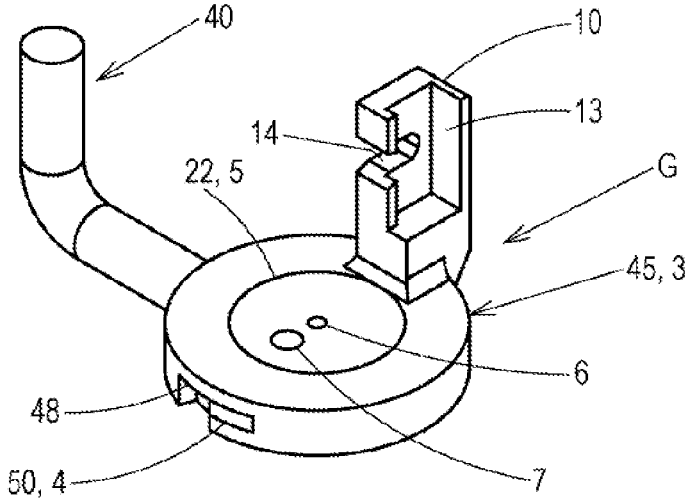
Figure 8A:
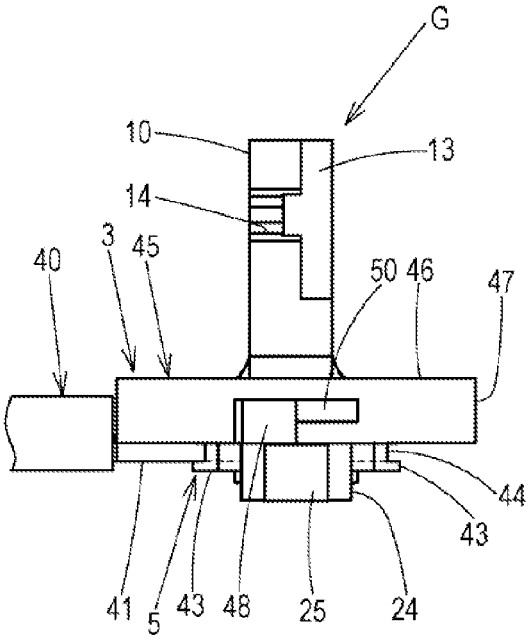
Figure 8B:
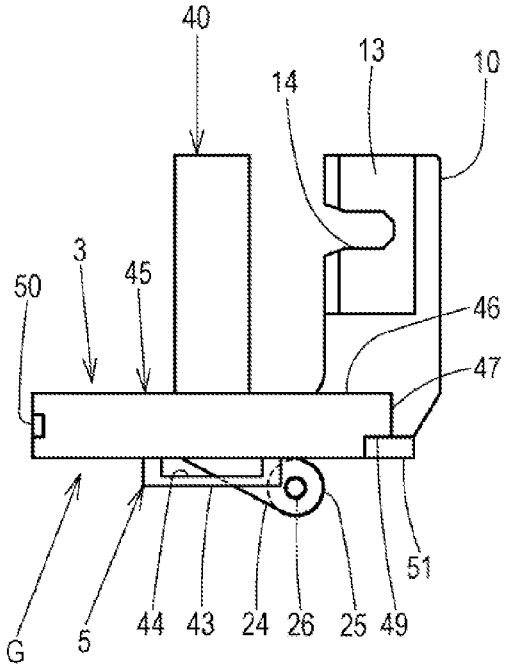
Figure 8C:
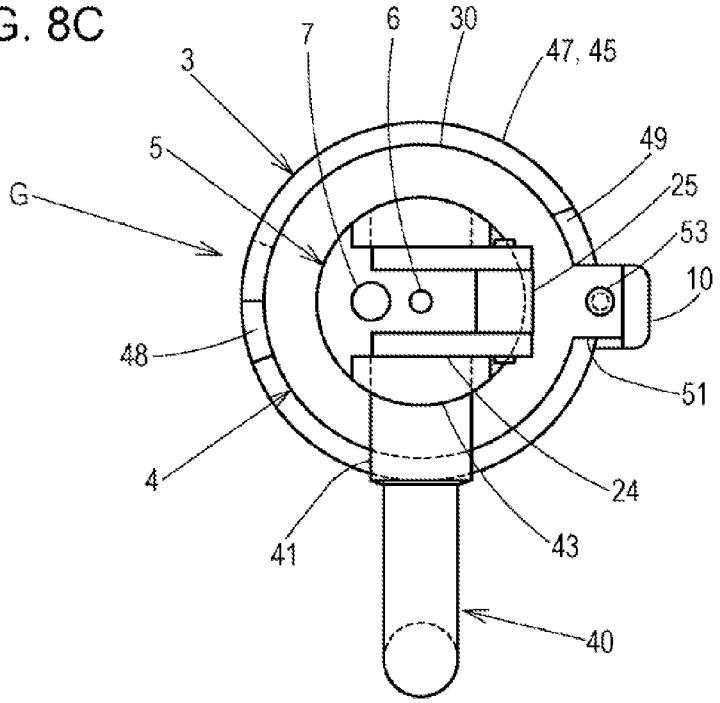

In the above state, the retaining screw 53 is inserted through the retaining hole 52 and is screwed into the screw hole (not shown) of the pressing holder 3 such that relative movement between the pressing holder 3 and the guide support board 4 is stopped connecting the pressing holder 3 and the guide support board 4 to each other (see FIG. 7B).

In the present exemplary embodiment, the hook-shaped hole 48, the connection recess 49, the fitting projection 50, the connection protrusion 51, and the retaining screw 53 configure a connection mechanism of the pressing holder 3 and the guide support board 4.

Similar to the first exemplary embodiment, the assembled cord guide device G positioned with the recess 13 of the holder arm 10 and the horizontal bolt hole 14 is attached to the guide attachment rod 1.

By fitting the insertion piece 41 of the operation lever 40 into the insertion hole 44 of the cord guide 5, the cord guide device G of the present exemplary embodiment is capable of easily rotating the cord guide 5 with the operation of the operation lever 40.

Accordingly, when starting to sew the cord C on the cloth N, by operating the operation lever 40 after moving the cloth N so that the needle hole 6 coincides with the needle location point at the start of sewing, the guide hole 7 can be positioned on the planned track C2 of the cord, and the cord guide 5 can be positioned easily at the start of sewing.

The effect of the cord guide device G in that the cord guide 5 following the movement of the cloth N rotates so that the guide hole 7 is positioned on the planned track C2 is similar to that described in the first exemplary embodiment.

Third Exemplary Embodiment

A third exemplary embodiment provided with, as a rotation mechanism, a drive mechanism that rotates the cord guide according to a moving direction of the cloth detected by an angle sensor will be described next.

Hereinafter, components that are the same as the first exemplary embodiment will be designated with the same reference numerals and points that are different will be described mainly.

Figure 9A:
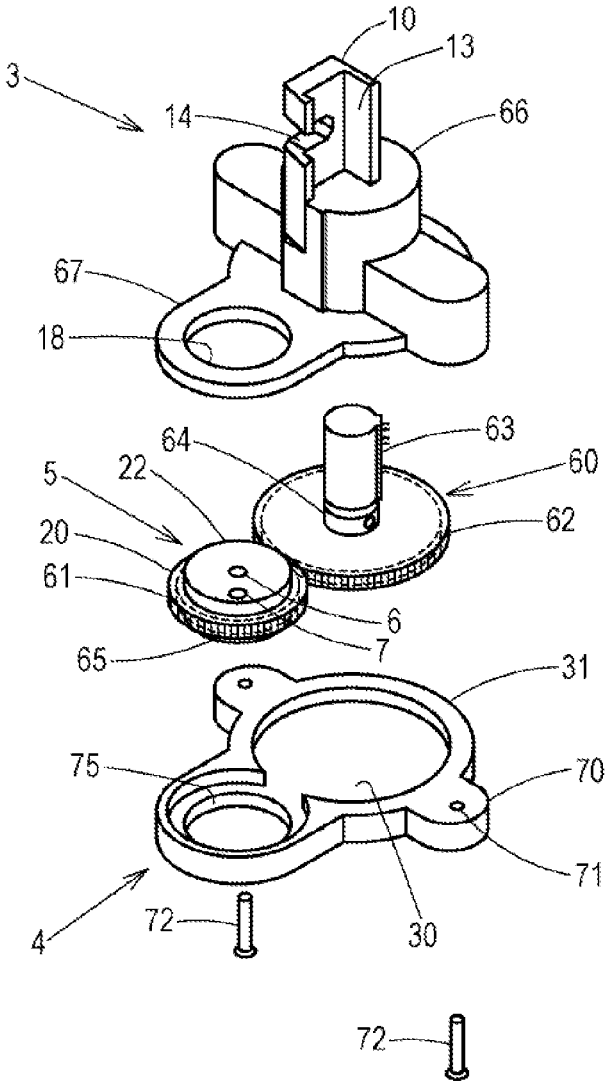
Figure 9B:
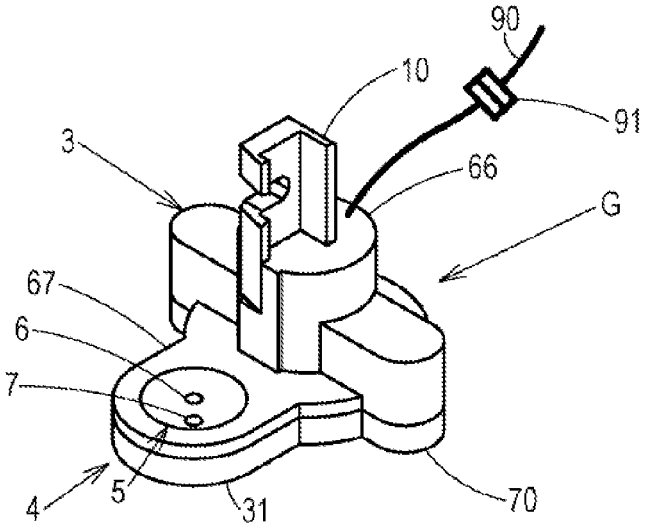

As illustrated in FIGS. 9A and 9B, a driven gear 61 is provided on the outer peripheral edge of the base 20 of the cord guide 5. A drive mechanism 60 including a drive gear 62 that meshes with the driven gear 61 is accommodated inside a base 66 provided in the base portion of the holder arm 10 of the pressing holder 3.

A pulse motor 63 that rotates a shaft 64 on the basis of information from an angle sensor (not shown) is attached to the shaft 64 of the drive gear 62. The pulse motor 63 is mounted in the base 66 so as not to rotate.

In the present exemplary embodiment, the driven gear 61 that is provided on the outer periphery of the base 20 configures a transmission gear integrally with the base 20; however, a transmission gear that transmits rotation to the cord guide 5 may be provided separately from the base 20.

A pressing upper plate 67 is provided on an underside of the base 66 of the pressing holder 3 so as to extend horizontally flush with the underside. The centering hole 18 is provided in the pressing upper plate 67.

The guide support board 4 is provided with the bottom plate 30 on the inner peripheral side of the peripheral wall 31 so as to accommodate and support the cord guide 5 and the drive gear 62. A pressing hole 75 into which a pressing protrusion 65 that is concentrically provided on the lower portion of the base 20 in a protruding manner is fitted is provided in an area of the bottom plate 30 that supports the cord guide 5.

The pressing protrusion 65 is configured so as to have the same diameter as the diameter of the projection 22 in which the guide hole 7 is disposed. The outer peripheral edge of the underside of the base 20 that is on the outer peripheral side with respect to the pressing protrusion 65 is supported by the bottom plate 30.

Lug portions 70 for connecting the guide support board 4 to the pressing holder 3 are provided on the outer peripheral of the peripheral wall 31 in a protruding manner. Retaining holes 71 into which retaining screws 72 are inserted are provided in the lug portions 70.

The height of the peripheral wall 31 is configured so that the upper end of the peripheral wall 31 abuts against the undersides of the base 66 and the pressing upper plate 67 when the guide support board 4 is connected to the pressing holder 3.

Note that the connection mechanism of the pressing holder 3 and the guide support board 4 may be in various forms and is not limited to connection through the screws described above.

Furthermore, as it has been described in the first exemplary embodiment, the positioning of the cord guide 5 with respect to the sewing machine body is not limited to positioning through the holder arm 10 of the pressing holder 3 and the centering hole 18.

Figure 10A:
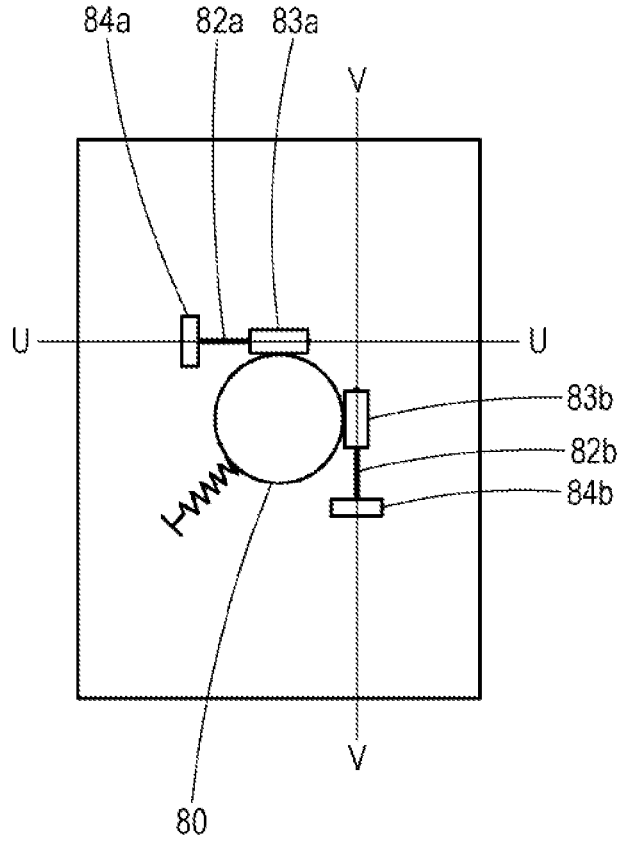

The angle sensor (not shown) will be described. As illustrated in a schematic diagram in FIG. 10A, the angle sensor includes a ball 80 that rotates while being pressed against the cloth N, two detection rollers 83*a* and 83*b* that abut against the ball 80, detection shafts 82*a* and 82*b* that support the two detection rollers 83*a* and 83*b*, respectively, and that are orthogonal with respect to each other, and encoders 84*a* and 84*b* that are attached to the detection shafts 82*a* and 82*b*, respectively.

The encoders 84*a* and 84*b* detect the amount of rotation per unit time of the detection rollers 83*a* and 83*b*, respectively, in other words, the encoders 84*a* and 84*b* detect rotating speeds Ma and Mb of the detection rollers 83*a* and 83*b*, respectively, and output the rotation detection signal to an angle calculation unit.

Figure 10B:
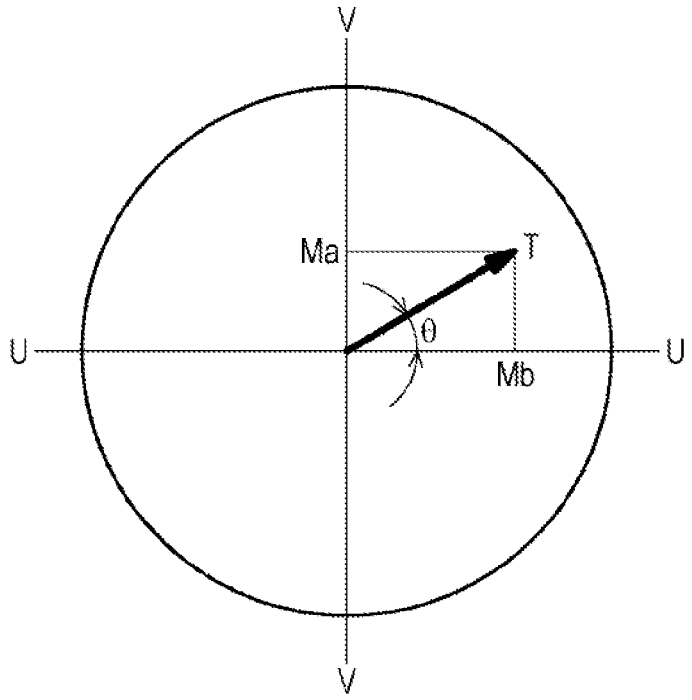

Since the rotating speeds Ma and Mb are the detected rotating speeds of the ball 80 about the axis of the shaft 82*a* extending in a U-U direction and the axis of the shaft 82*b* extending in a V-V direction that are orthogonal to each other, as illustrated in FIG. 10B, from the rotation detection signal based on the rotating speeds Ma and Mb, the angle calculation unit is capable of calculating an angle θ of a moving direction T with respect to the U-U axis in a U-U and V-V coordinate system.

If the directions of the axes U-U and V-V coincide with the axes of coordinates of the cloth N, the calculated angle θ is the actual moving direction of the cloth N, and if the directions of the axes U-U and V-V are inclined against the axes of coordinates of the cloth N, the angle θ may be converted into the axes of coordinates of the cloth N to calculate the actual moving direction of the cloth N.

The calculation of the angle θ, the issuance of the rotation command to the pulse motor 63, and the like are processed by a controller built in the sewing machine body. Reference numeral 90 in FIG. 9B is a signal wire that connects the pulse motor 63 and the angle sensor (not shown) to the controller in the sewing machine body, and reference numeral 91 is a connector.

Note that in the cord guide device G of the present exemplary embodiment, not limited to the angle sensor illustrated herein, various known angle sensors that calculate the moving direction with positional information may be employed.

Use modes and effects of the present exemplary embodiment will be described next with reference to the drawings.

In order to assemble the cord guide device G from a state in FIG. 9A, first, the pulse motor 63 is accommodated inside the base 66 and the drive mechanism 60 is mounted in the pressing holder 3.

The pressing protrusion 65 is fixed into the pressing hole 75 and the guide support board 4 supporting the cord guide 5 is attached to the pressing holder 3 with the retaining screws 72. In the above case, the projection 22 is fitted into the centering hole 18 and the driven gear 61 and the drive gear 62 are meshed to each other.

Since the underside of the cord guide 5 and the lower end of the guide hole 7 can be approached towards the cloth N with the pressing protrusion 65, the cord C can be guided to the needle location point in a stable manner and rising of the cloth N caused by the sewing needle 2 can be suppressed small.

Note that if the pulse motor 63 is configured with a simple structure in which the attachment of the pulse motor 63 is completed by merely fitting the pulse motor 63 to the base 66, the cord guide 5 and the drive mechanism 60 whose gears are meshed to each other can be attached to the pressing holder 3 while being supported by the guide support board 4.

Similar to the first exemplary embodiment, the assembled cord guide device G positioned with the recess 13 of the holder arm 10 and the horizontal bolt hole 14 is attached to the guide attachment rod 1.

In the cord guide device G of the present exemplary embodiment, when the cloth N is moved, the ball 80 in contact with the cloth N rotates due to frictional force, the rotating speeds Ma and Mb about the two shafts that are orthogonal with respect to each other are detected by the two detection rollers 83*a* and 83*b* in contact with the ball 80, and the angle θ of the moving direction T of the cloth N is calculated with the rotating speeds Ma and Mb.

On the basis of the angle θ calculated by the angle sensor, the pulse motor 63 rotates the cord guide 5 so that, with respect to the needle hole 6, the guide hole 7 is always positioned in a direction opposite to the moving direction T of the cloth N.

In the present exemplary embodiment, since the ball 80 in contact with the cloth N only rotates the detection rollers 83*a* and 83*b* and the encoders 84*a* and 84*b*, only a small load is applied to the cloth N, and since the cord guide 5 is rotated with a pulse motor 63, the moving operation of the cloth N can be performed swiftly.

The cord guide device of the present disclosure is capable of guiding a piece of cord or the like to a sewing position so that the cord or the like is not deviated from the needle location point by just moving the cloth. Furthermore, since mounting and dismounting of the cord guide device is facilitated with a simple structure, the cord guide device can be suitably used, particularly, in household sewing machines.

What is claimed is:

1. A cord guide device that is attached to a guide attachment rod of a sewing machine body, the cord guide device comprising:

a disc-shaped cord guide in which a needle hole through which a sewing needle passes is provided in a center and in which a guide hole through which a piece of cord passes is provided, the guide hole being positioned eccentrically with respect to the needle hole;

a guide support board that supports an underside of the cord guide;

a pressing holder that, by being connected to the guide support board, restricts an upper surface of the cord guide and holds the cord guide such that the cord guide is rotatable about the needle hole; and a rotation mechanism that rotates the cord guide according to a movement of a piece of cloth.

2. The cord guide device according to claim 1, wherein the rotation mechanism includes a guide arm that extends from the underside of the cord guide, a rotating shaft that is attached to a lower end portion of the guide arm, and a rotating body that is attached to the rotating shaft serving as an axis of symmetry, the rotating body being in contact with the cloth, and the rotating shaft is disposed in a direction orthogonal to a line connecting a center of the guide hole and a center of the needle hole, the rotating shaft being attached to the guide arm at a position that is on an opposite side of the guide hole with respect to the needle hole and that is eccentric by a predetermined distance from the needle hole.

3. The cord guide device according to claim 2, wherein the rotating body is a cylindrical roller.

4. The cord guide device according to claim 1, wherein the cord guide includes an operation reception portion that includes an insertion hole that extends in a radial direction and an operation lever that is capable of being fitted into the operation reception portion.

5. The cord guide device according to claim 4, wherein the rotation mechanism includes a guide arm that extends from the underside of the cord guide, a rotating shaft that is attached to a lower end portion of the guide arm, and a rotating body that is attached to the rotating shaft serving as an axis of symmetry, the rotating body being in contact with the cloth, and the rotating shaft is disposed in a direction orthogonal to a line connecting a center of the guide hole and a center of the needle hole, the rotating shaft being attached to the guide arm at a position that is on an opposite side of the guide hole with respect to the needle hole and that is eccentric by a predetermined distance from the needle hole.

6. The cord guide device according to claim 5, wherein the rotating body is a cylindrical roller.

7. The cord guide device according to claim 1, wherein the rotation mechanism includes an angle sensor that detects a direction in which the cloth has moved with respect to a reference axis direction in plan view, and a drive mechanism that rotates the cord guide so that the guide hole is positioned, with respect to the needle hole, in a direction opposite to the direction detected by the angle sensor in which the cloth has moved.

8. The cord guide device according to claim 7, wherein the angle sensor includes a ball that comes into contact with the cloth and that freely rotates with frictional force with the cloth, two rollers that rotate by being in contact with the ball, axes of the two rollers being orthogonal with respect to each other in plan view, encoders that each detect an amount of rotation of the corresponding one of the rollers, and an angle calculation unit that calculates, on a basis of detection data of the encoders, the direction in which the cloth has moved.

9. The cord guide device according to claim 7, wherein the drive mechanism includes a drive motor, a drive gear that is attached to a rotating shaft of the drive motor, and a transmission gear that meshes with the drive gear and that transmits a rotation to the cord guide.

10. The cord guide device according to claim 9, wherein the angle sensor includes a ball that comes into contact with the cloth and that freely rotates with frictional force with the cloth, two rollers that rotate by being in contact with the ball, axes of the two rollers being orthogonal with respect to each other in plan view, encoders that each detect an amount of rotation of the corresponding one of the rollers, and an angle calculation unit that calculates, on a basis of detection data of the encoders, the direction in which the cloth has moved.

11. A sewing machine, comprising:

a cord guide device; and a guide attachment rod that attaches the cord guide device to a sewing machine body, wherein the cord guide device includes a disc-shaped cord guide in which a needle hole through which a sewing needle passes is provided in a center and in which a guide hole through which a piece of cord passes is provided, the guide hole being positioned eccentrically with respect to the needle hole, a guide support board that supports an underside of the cord guide, a pressing holder that, by being connected to the guide support board, restricts an upper surface of the cord guide and holds the cord guide such that the cord guide is rotatable about the needle hole, and a rotation mechanism that rotates the cord guide according to a movement of a piece of cloth.

12. The sewing machine according to claim 11, wherein the rotation mechanism includes a guide arm that extends from the underside of the cord guide, a rotating shaft that is attached to a lower end portion of the guide arm, and a rotating body that is attached to the rotating shaft serving as an axis of symmetry, the rotating body being in contact with the cloth, and the rotating shaft is disposed in a direction orthogonal to a line connecting a center of the guide hole and a center of the needle hole, the rotating shaft being attached to the guide arm at a position that is on an opposite side of the guide hole with respect to the needle hole and that is eccentric by a predetermined distance from the needle hole.

13. The sewing machine according to claim 12, wherein the rotating body is a cylindrical roller.

14. The sewing machine according to claim 11, wherein the cord guide includes an operation reception portion that includes an insertion hole that extends in a radial direction and an operation lever that is capable of being fitted into the operation reception portion.

15. The sewing machine according to claim 14, wherein the rotation mechanism includes a guide arm that extends from the underside of the cord guide, a rotating shaft that is attached to a lower end portion of the guide arm, and a rotating body that is attached to the rotating shaft serving as an axis of symmetry, the rotating body being in contact with the cloth, and the rotating shaft is disposed in a direction orthogonal to a line connecting a center of the guide hole and a center of the needle hole, the rotating shaft being attached to the guide arm at a position that is on an opposite side of the guide hole with respect to the needle hole and that is eccentric by a predetermined distance from the needle hole.

16. The sewing machine according to claim 15, wherein the rotating body is a cylindrical roller.

17. The sewing machine according to claim 11, wherein the rotation mechanism includes an angle sensor that detects a direction in which the cloth has moved with respect to a reference axis direction in plan view, and a drive mechanism that rotates the cord guide so that the guide hole is positioned, with respect to the needle hole, in a direction opposite to the direction detected by the angle sensor in which the cloth has moved.

18. The sewing machine according to claim 17, wherein the angle sensor includes a ball that comes into contact with the cloth and that freely rotates with frictional force with the cloth, two rollers that rotate by being in contact with the ball, axes of the two rollers being orthogonal with respect to each other in plan view, encoders that each detect an amount of rotation of the corresponding one of the rollers, and an angle calculation unit that calculates, on a basis of detection data of the encoders, the direction in which the cloth has moved.

19. The sewing machine according to claim 17, wherein the drive mechanism includes a drive motor, a drive gear that is attached to a rotating shaft of the drive motor, and a transmission gear that meshes with the drive gear and that transmits a rotation to the cord guide.

20. The sewing machine according to claim 19, wherein the angle sensor includes a ball that comes into contact with the cloth and that freely rotates with frictional force with the cloth, two rollers that rotate by being in contact with the ball, axes of the two rollers being orthogonal with respect to each other in plan view, encoders that each detect an amount of rotation of the corresponding one of the rollers, and an angle calculation unit that calculates, on a basis of detection data of the encoders, the direction in which the cloth has moved.

* * * * *